US006916157B2

(12) United States Patent
Leonhard

(10) Patent No.: US 6,916,157 B2
(45) Date of Patent: Jul. 12, 2005

(54) CLAM SHELL PUMP HOUSING DEFINING PASSAGEWAYS AND A SEALED PRESSURE OR VACUUM CHAMBER

(75) Inventor: Todd W. Leonhard, Sheboygan, WI (US)

(73) Assignee: Thomas Industries Inc., Sheboygan, WI (US)

( * ) Notice: Subject to any disclaimer, the term of this patent is extended or adjusted under 35 U.S.C. 154(b) by 32 days.

(21) Appl. No.: 10/169,566

(22) PCT Filed: Jan. 8, 2001

(86) PCT No.: PCT/US01/00540

§ 371 (c)(1),
(2), (4) Date: Jul. 2, 2002

(87) PCT Pub. No.: WO01/51812

PCT Pub. Date: Jul. 19, 2001

(65) Prior Publication Data

US 2003/0003003 A1 Jan. 2, 2003

Related U.S. Application Data

(60) Provisional application No. 60/175,183, filed on Jan. 10, 2000.

(51) Int. Cl.[7] ..... F04B 35/04

(52) U.S. Cl. ..... 417/234; 417/423.15; 417/572

(58) Field of Search ..... 417/234, 410.1, 417/423.5, 312, 413.1, 415, 423.12, 902, 405, 408, 416, 418, 423.2, 423.15; 415/182.1, 214.1, 215.1, 196, 203, 213.1, 218.1, 220

(56) References Cited

U.S. PATENT DOCUMENTS

| | | | | | |
|---|---|---|---|---|---|
| 3,573,405 | A | * | 4/1971 | Skinner et al. | 200/61.39 |
| 3,640,254 | A | * | 2/1972 | Manfredi | 123/25 B |
| 3,692,335 | A | | 9/1972 | Vickers et al. | 285/49 |
| 3,932,069 | A | * | 1/1976 | Giardini et al. | 417/420 |
| 5,040,950 | A | * | 8/1991 | Dalquist, III et al. | 417/234 |
| 5,071,069 | A | * | 12/1991 | Stirm | 239/128 |
| 5,137,434 | A | * | 8/1992 | Wheeler et al. | 417/368 |
| 5,718,571 | A | | 2/1998 | Rozek | 417/566 |
| 5,833,437 | A | * | 11/1998 | Kurth et al. | 417/36 |
| 6,164,932 | A | | 12/2000 | Tominaga et al. | 417/413.1 |
| 6,309,364 | B1 | * | 10/2001 | Cathaud et al. | 601/7 |

FOREIGN PATENT DOCUMENTS

| | | | |
|---|---|---|---|
| DE | 298 15 572 U | 11/1998 | F25D/23/00 |
| DE | 199 26 186 A | 12/2000 | F04B/39/10 |
| EP | 0 438 243 A | 7/1991 | F16L/5/02 |

* cited by examiner

*Primary Examiner*—Charles G. Freay
(74) *Attorney, Agent, or Firm*—Quarles & Brady LLP

(57) ABSTRACT

A pump has a motor pump unit enclosed by clam shell housing sections. The pump moves a working fluid through the housing to an outside load. Each section has intake walls defining a portion of an intake chamber and outlet walls defining a portion of an outlet chamber. The intake walls of each section seal against one another to define a sealed intake chamber which is in communication with the intake port of the pump unit, and the outlet walls of each section seal against one another to define a sealed outlet chamber which is in communication with the outlet port of the pump unit.

17 Claims, 5 Drawing Sheets

FIG. 1
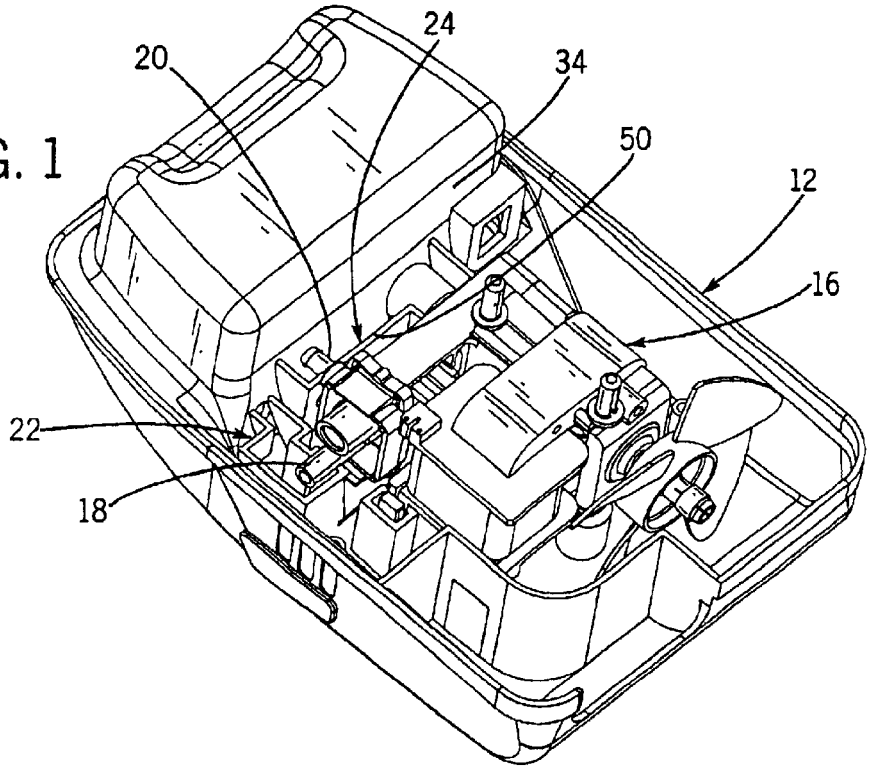
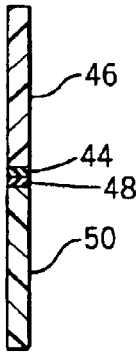
FIG. 4
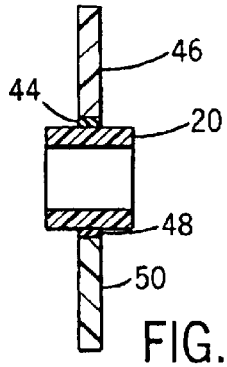
FIG. 5
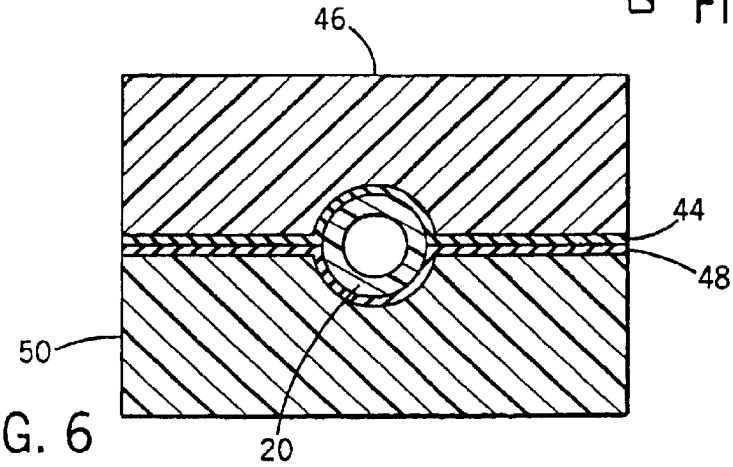
FIG. 6

CLAM SHELL PUMP HOUSING DEFINING PASSAGEWAYS AND A SEALED PRESSURE OR VACUUM CHAMBER

CROSS-REFERENCE TO RELATED APPLICATION

This claims the benefit of U.S. Provisional Patent Application No. 60/175,183 filed Jan. 10, 2000.

STATEMENT CONCERNING FEDERALLY SPONSORED RESEARCH OR DEVELOPMENT

Not applicable.

FIELD OF THE INVENTION

This invention relates to housings or cabinets for pumps such as compressors or vacuum pumps. In particular, this invention concerns such a pump in which clam shell halves of the housing form seals at their abutting edges to define pressure or vacuum chambers or passageways within the housing.

BACKGROUND OF THE INVENTION

In many applications, a compressor or vacuum pump is housed inside a cabinet (a.k.a., housing), which may be of molded plastic. In the case of a compressor, the compressor needs intake air, which must be drawn in from outside of the housing and directed to the intake port of the pump, the pump compresses it, and delivers it to a pressurized exhaust port. Typically, tubing Is used to direct the output of the exhaust port to a port which is accessible by the user from outside of the housing. The intake air delivered to the pump usually must be filtered, so that only filtered air is delivered to the intake port, and tubing or passageways are required to communicate the filtered air to the intake port.

SUMMARY OF THE INVENTION

The invention provides an improvement to a pump having clam shell housing sections in which each said housing section has one or more walls which seal against one or more walls of the other housing section to define a sealed pressure or vacuum chamber within the walls when the housing sections are brought together. The walls come together to provide a seal all the way around the chamber, which may be an inlet chamber, an outlet chamber, or a pressurized (including depressurized) passageway, so that a pressure difference can be contained in the chamber, either positive or negative. Thereby, additional tubing or passageways in addition to the housing for routing the intake and outlet of the pump are obviated.

In a preferred form, the walls are overmolded with an elastomeric sealing material. The walls may seal against one another in end to end contact, or a wall may seal against the side surface of another wall. In the latter case, it is preferred that the sealing edge of the elastomeric sealing material be tapered to make a good seal, and the underlying edge of the wall may also be tapered to help reinforce the sealing material. Edge to side sealing is done with the exposed side of the sealing material facing the high pressure side, so that the pressure helps establish the seal.

The chamber may be in communication with either the intake or outlet port of the pump. At least one of the walls in each housing section may be formed with a half-circular recess in an edge of the wall so that the half circular recesses come together to seal around a circular intake or outlet port of the pump when the housing sections are brought together. A hole or tubular port may also be formed in one or more of the walls to create a means for entry of ambient air to the chamber, mainly for an intake chamber, or a port to which a tube could be connected, mainly for an outlet chamber.

The foregoing and other objects and advantages of the invention will appear in the detailed description which follows. In the description, reference is made to the accompanying drawings which illustrate a preferred embodiment of the invention.

BRIEF DESCRIPTION OF THE DRAWINGS

FIG. 1 is a top perspective view of one clam shell half of a housing containing a compressor;

FIG. 4 is a sectional view from the plane of the line 4—4 of FIG. 2, drawn with both clam shell halves assembled together;

FIG. 5 is a cross-sectional view from the plane of the line 5—5 of FIG. 2, drawn with the two clam shell halves assembled together;

FIG. 6 is a cross-sectional view from the plane of the line 6—6 of FIG. 2, drawn with the two clam shell halves assembled together;

DETAILED DESCRIPTION OF THE PREFERRED EMBODIMENT

Figure 2:
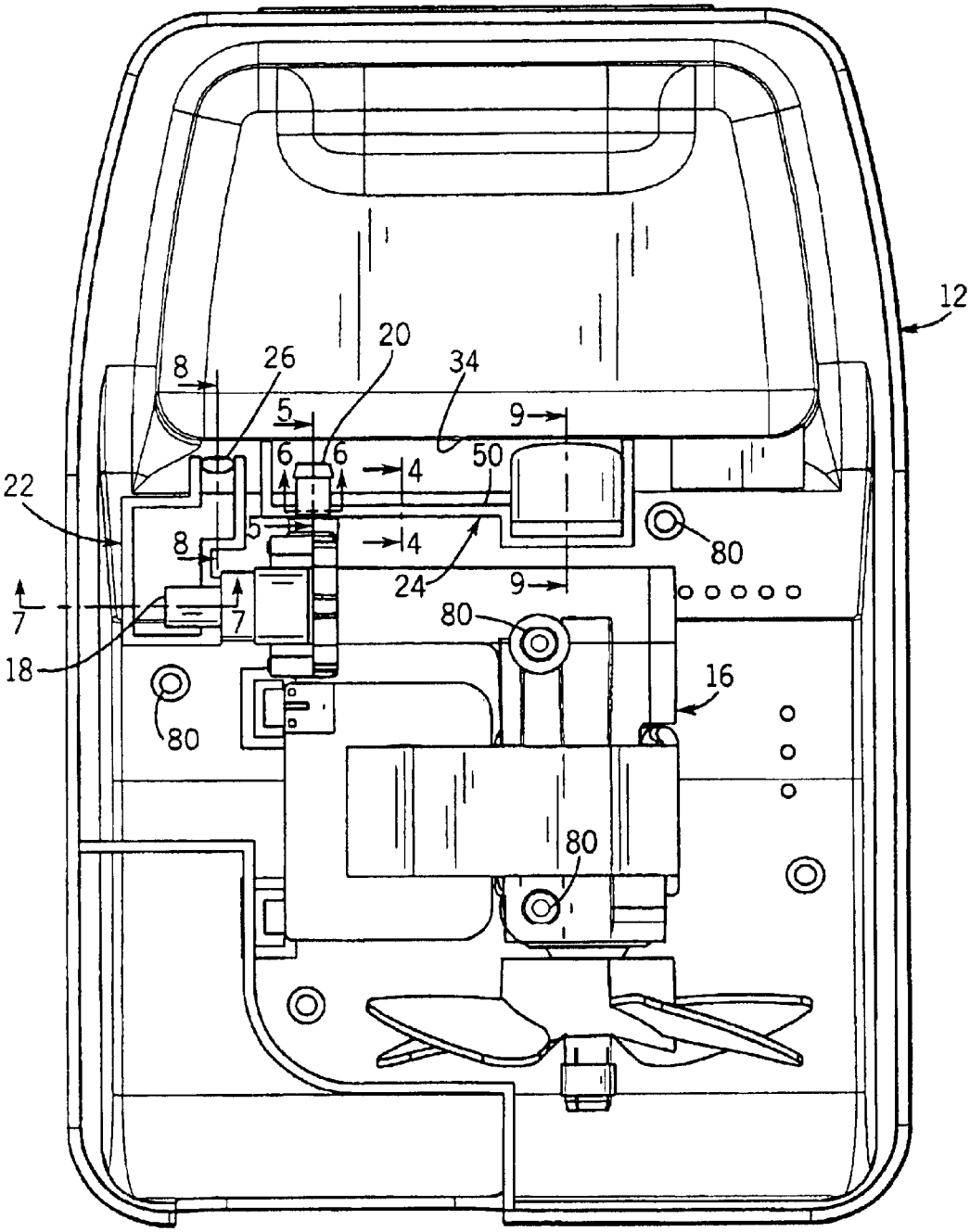
FIG. 2 is a top plan view of the clam shell half of FIG. 1.
Figure 3:
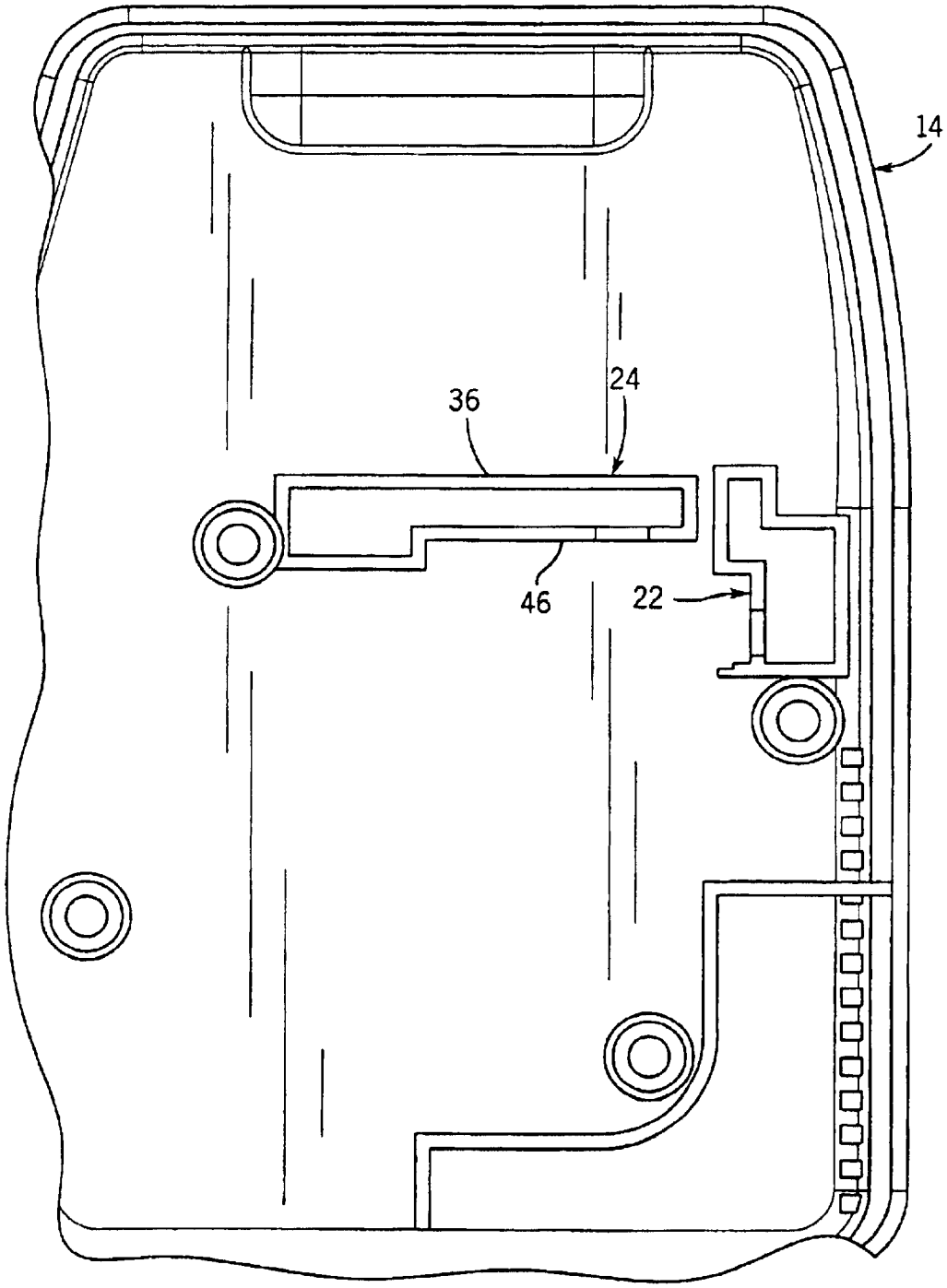
FIG. 3 is a bottom plan view showing the other clam shell half which mates with the clam shell half shown in FIGS. 1 and 2.
Figure 9:
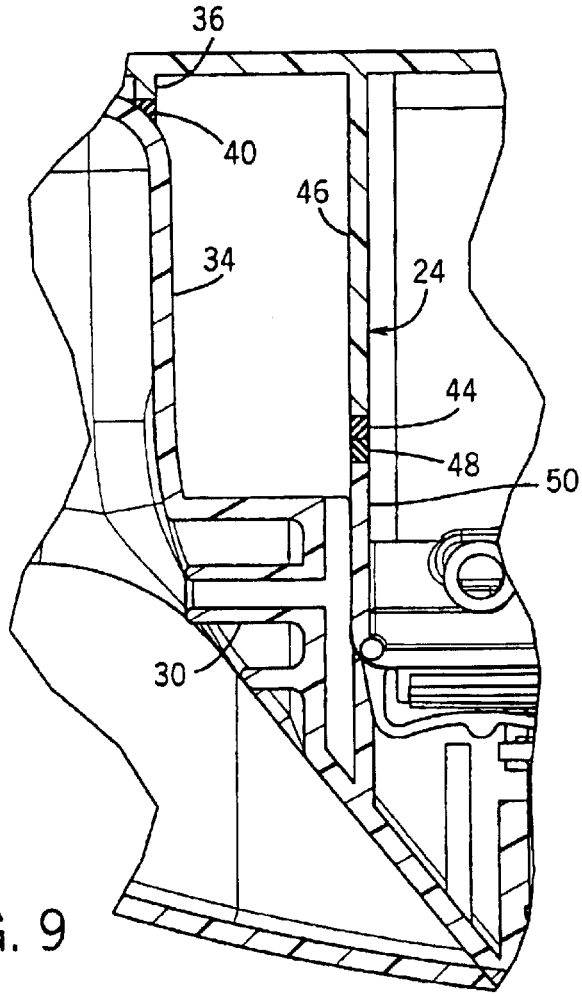
FIG. 9 is a cross-sectional view from the plane of the line 9—9 of FIG. 2, drawn with the two clam shell halves assembled together.
Figure 10:
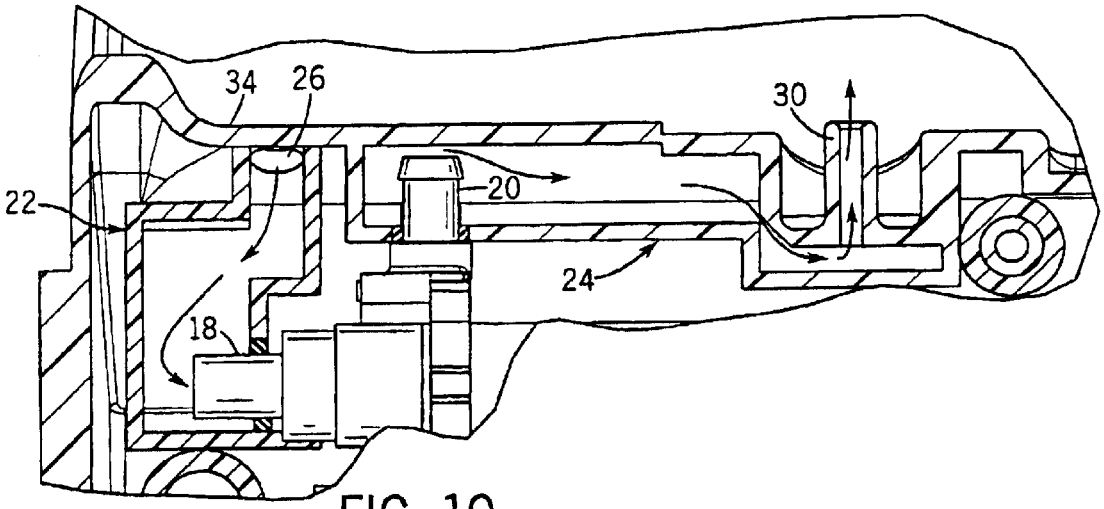
FIG. 10 is a top cross-sectional view illustrating the air flow paths through the intake and exhaust chambers defined by the housing.

FIGS. 1 and 2 illustrate one clam shell half 12 of a nebulizer housing and FIG. 3 illustrates the other clam shell half 14. The nebulizer includes a motor pump unit 16 which has an inlet port 18 and an exhaust port 20. The inlet port 18 opens into and draws air from an intake chamber 22 and the exhaust port 20 opens into and expels pressurized air into an exhaust chamber 24. Air is drawn into the intake chamber 22 through a hole 26 in one of the walls of the chamber 22, and a filter (not shown) may be installed in or over the hole 26. Air is exhausted from the exhaust chamber 24 through an outlet port 30 which is formed in one of the walls of the exhaust chamber 24 as shown in FIGS. 9 and 10.

Part of each chamber 22 and 24 is formed by the clam shell half 12 and the other part of each chamber 22 and 24 is formed by the clam shell half 14. Together, walls of the clam shell halves 12 and 14 create the chambers 22 and 24, and the chambers 22 and 24 are sealed against the respective ports 18 and 20 so that the chambers 22 and 24 are sealed except at the respective ports 18, 26, and 20, 30.

The walls of the clam shell halves 12 and 14 which make up the chambers 22, 24 are thin walled molded plastic sections which in each half are integrally molded with the other walls of the half. The clam shell halves 12 and 14 would typically be made of a relatively hard and stiff plastic material such as high impact polystyrene. The walls which make up the chambers 22 and 24 would have a typical thickness of 0.090 inches. The edges of the walls that make up the chambers 22, 24, where they abut all the way around the respective chamber 22, 24, come together to seal the interiors of the chambers 22, 24 against a pressure difference. However, for the exhaust chamber 24, along wall 34, the edges do not abut, although a wall 36 of the clam shell half 14 abuts the side surface of wall 34.

So that the abutments of the walls of the clam shell half 14 with the walls of the clam shell half 12 may be sufficient so as to create a seal against a pressure difference between the chambers 22 and 24 and atmospheric pressure, at each interface between the walls of the halves 12 and 14, the interfacing surfaces are coated with a relatively soft, e.g. 50 to 60 durometer, thermoplastic elastomer or thermoplastic rubber (TPR) such as Santoprene. This is preferably overmolded onto the edges of the walls that create the seals for the chambers 22, 24. This can be done in a two-shot injection molding process, either in which the harder plastic which makes up the majority of the halves 12 and 14 is first molded in one mold, and then the halves 12 and 14 are put in separate molds to overmold the relatively softer elastomeric material, or in which the harder plastic is molded in one mold in one shot and then cores of the mold are retracted to make room for a shot of the relatively softer material over the edges of the walls that form the chambers 22 and 24.

As shown in FIG. 9, in the case of the seal between the walls 34 and 36, a single TPR gasket 40 is molded onto the edge of the wall 36 and has a tapered configuration so as to generally match the curvature of the surface of the wall 34 and thereby create a seal between the wall 36, to which the gasket 40 is attached, and the wall 34 which abuts the gasket 40. On the other side of the chamber 24, a gasket 44 is overmolded onto the edge of wall 46 and a gasket 48 is overmolded onto the edge of wall 50. The gaskets 44 and 48 abut each other to create a seal between them, and thereby create a seal between the walls 46 and 50. A gasketed interface is provided all the way around each chamber 22 and 24. Thereby, the only inlet to chamber 22 is hole 26 and the only outlet is port 18, and the only inlet to chamber 24 is port 20 and the only outlet is port 30. In normal operation, chamber 22 is subjected to quite low pressure differences, being an intake chamber, with the only pressure difference being created by a filter which may be installed in hole 26, but chamber 24 may be subjected to pressures on the order of about 15 psi.

FIGS. 5 and 6 illustrate how seals are created around the ports 18 and 20 of the motor pump unit 16. Semi-circles are formed in the walls of the two halves 12 and 14 which, when the edges of the semi-circular openings are overmolded with the relatively soft gasket material, closely mate with the outside diameters of the ports 18 and 20 so as to cradle the ports. As an enhancement to the invention, rather than gaskets such as the gasket 44 and 48 meeting along a flat surface, one of the gaskets 44, 48 may be formed with a pointed edge and the other gasket 44, 48 may be formed flat, or with a V-shaped groove to receive the pointed edge to create a form fit, to thereby create a more reliable seal.

Figure 7:
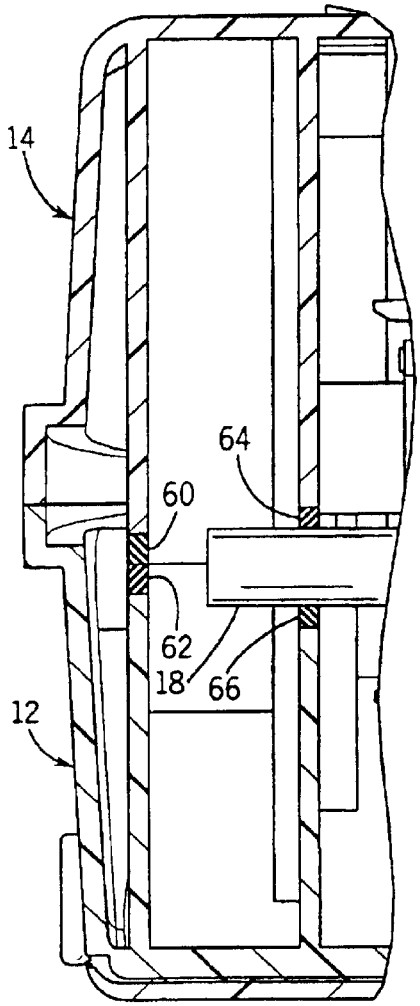
FIG. 7 is a cross-sectional view from the plane of the line 7—7 of FIG. 2, drawn with the two clam shell halves assembled together.
Figure 8:
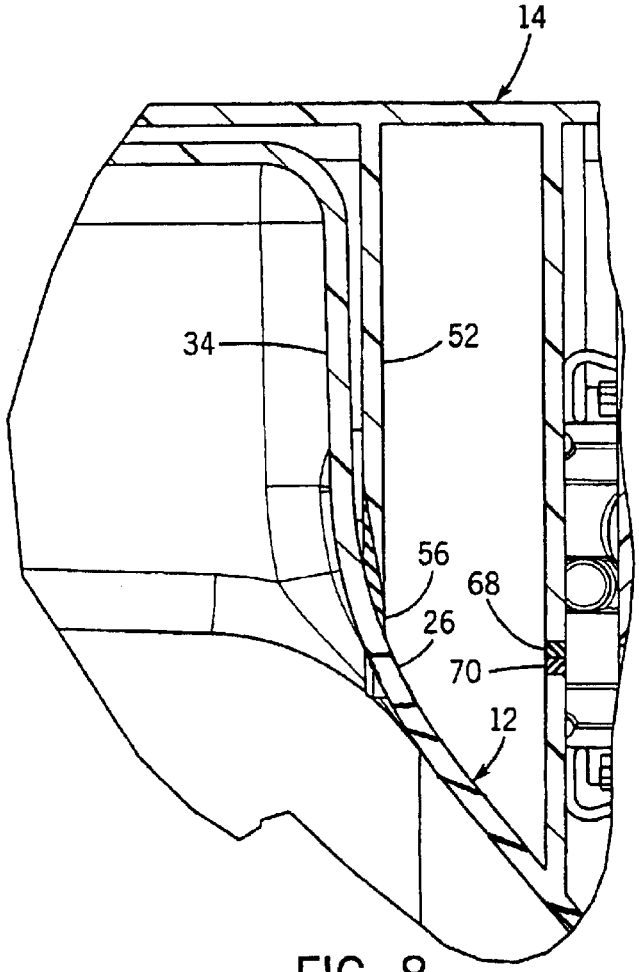
FIG. 8 is a cross-sectional view from the plane of the 8—8 of FIG. 2, drawn with the two clam shell halves assembled together.

FIGS. 7 and 8 illustrate seals that are created for the intake chamber 22. The above description for the seals of the exhaust chamber 24 applies to the exhaust chamber 22 as well, although with different walls and gasket edges meeting. In FIG. 7, mating overmolded gaskets are identified by reference numbers 60; 62 and 64; 66. In FIG. 8, mating overmolded gaskets are identified by reference numbers 68, 70. In FIG. 8, a relatively tall wall 52 has gasket material 56 at its end, which is tapered, and the gasket material 56 is also tapered to press up against the side of wall 34 of the half 12. The tapering of the end of the wall 52 helps stiffen the gasket 56 against bending to improve the seal against the curved surface of the wall 34 which is created by pressing the gasket 56 against it.

The two cabinet halves 12, 14 are held together by any suitable means, such as snap fits, fasteners through holes 80, a combination of snap fits and fasteners, or any other suitable means.

Many modifications and variations to the preferred embodiment described will be apparent to those skilled in the art which will still embody the invention. For example, a sealed passageway incorporating the invention could be made in any shape. Therefore the invention should not be limited to the preferred embodiment described.

I claim:

1. In a pump having clam shell housing sections, the improvement Wherein said clam shell housing sections enclose a motor pump unit for pumping a working fluid to be delivered to a load outside said housing sections and each said housing section has one or more walls which create a seal against one or more walls of another housing section to define a sealed pressure or vacuum chamber of the working fluid within said walls when said housing sections are brought together to enclose said motor pump unit, wherein at least one of said walls has an edge which is overmolded with an elastomeric seal material.

2. The improvement of claim 1, wherein said chamber is in communication with an intake port of said pump.

3. The improvement of claim 1, wherein said chamber is in communication with an outlet port of said pump.

4. The improvement of claim 1, wherein at least one of said walls includes at least a portion of an inlet hole formed therein.

5. The improvement of claim 1, wherein at least one of said walls includes at least a portion of a port formed therein.

6. The improvement of claim 1, wherein walls of said housing sections mate in end to end contact to define at least part of said chamber.

7. In a pump having clam shell housing sections, the improvement wherein said clam shell housing sections enclose a motor pump unit for pumping a working fluid to be delivered to a load outside said housing sections and each said housing section has one or more walls which create a seal against one or more walls of another housing section to define a sealed pressure or vacuum chamber of the working fluid within said walls when said housing sections are brought together to enclose said motor pump unit, wherein at least one of said walls in each said housing section contains a half-circular recess in an edge of said wall, and wherein said half circular recesses come together to seal around a circular port of said pump when said housing sections are brought together.

8. In a pump having clam shell housing sections, the improvement wherein said clam shell housing sections enclose a motor pump unit and each said housing section has one or more walls which create a seal against one or more walls of another housing section to define a sealed pressure or vacuum chamber within said walls when said housing sections are brought together to enclose said motor pump unit, wherein at least one wall of at least one of said housing sections seals against a side surface of a wall of the other housing section to define at least part of said chamber, wherein said at least one wall has a tapered end.

9. The improvement of claim 8, wherein said at least one wall is overmolded with an elastomeric sealing material.

10. In a pump having clam shell housing sections, the improvement wherein said clam shell housing sections enclose a motor pump unit and each said housing section has one or more walls which seal against one or more walls of another housing section to define a sealed pressure or vacuum chamber within said walls when said housing sections are brought together to enclose said motor pump unit, wherein at least one wall of at least one of said housing sections seals against a side surface of a wall of the other housing section to define at least part of said chamber, wherein said at least one wall has a tapered end, wherein said at least one wail is overmolded with an elastomeric sealing material, wherein said elastomeric sealing material tapers toward the tapered end of the at least one wall and wherein the underlying at least one wall is also tapered.

11. A pumping unit comprising:

a motor pump unit pumping a working fluid through an intake port and an outlet port;

first and second clam shell housing sections which enclose said motor pump unit, each said section having intake walls defining a portion of an intake chamber and outlet walls defining a portion of an outlet chamber;

wherein said intake walls of said first section create a seal against the intake walls of the second section to define a sealed intake chamber for the working fluid which is in communication with the intake port of said pump; and wherein said outlet walls of said first section create a seal against the outlet walls of the second section to define a sealed outlet chamber for the working fluid which is in communication with an outlet port of said pump for delivering the working fluid to a load outside the housing sections.

12. A pumping unit as claimed in claim 11, wherein a hole is formed in a wall of said intake chamber.

13. A pumping unit as claimed in claim 11, wherein an outlet port is formed in a wall of said outlet chamber.

14. A pumping unit comprising:

a motor pump unit having an intake port and an outlet port;

first and second clam shell housing sections which enclose said motor pump unit, each said section having intake walls defining a portion of an intake chamber and outlet walls defining a portion of an outlet chamber;

wherein said intake walls of said first section seal against the intake walls of the second section to define a sealed intake chamber which is in communication with the intake port of said pump;

wherein said outlet walls of said first section seal against the outlet walls of the second section to define a sealed outlet chamber which is in communication with an outlet port of said pump; and wherein Intake walls of said first and second sections seal against an intake port of said pump and outlet walls of said first and second sections seal against an outlet port of said pump.

15. A pumping unit comprising:

a motor pump unit pumping a working fluid through an intake port and an outlet port;

first and second clam shell housing sections which enclose said motor pump unit, each said section having intake walls defining a portion of an intake chamber and outlet walls defining a portion of an outlet chamber;

wherein said intake walls of said first section seal against the intake walls of the second section to define a sealed intake chamber for the working fluid which is in communication with the intake port of said pump;

wherein said outlet walls of said first section seal against the outlet walls of the second section to define a sealed outlet chamber for the working fluid which is in communication with an outlet port of said pump for delivering the working fluid to a load outside the housing sections; and wherein intake walls of said first and second sections seal against one another in end to end contact.

16. A pumping unit comprising:

a motor pump unit pumping a working fluid through an intake port and an outlet port;

first and second clam shell housing sections which enclose said motor pump unit, each said section having intake walls defining a portion of an intake chamber and outlet walls defining a portion of an outlet chamber;

wherein said intake walls of said first section seal against the intake walls of the second section to define a sealed intake chamber for the working fluid which is in communication with the intake port of said pump;

wherein said outlet walls of said first section seal against the outlet walls of the second section to define a sealed outlet chamber for the working fluid which is in communication with an outlet port of said pump for delivering the working fluid to a load outside the housing sections; and wherein outlet walls of said first and second sections seal against one another in end to end contact.

17. A pumping unit comprising:

a motor pump unit having an intake port and an outlet port;

first and second clam shell housing sections which enclose said motor pump unit, each said section having intake walls defining a portion of an intake chamber and outlet walls defining a portion of an outlet chamber;

wherein said intake walls of said first section seal against the intake walls of the second section to define a sealed intake chamber which is in communication with the intake port of said pump;

wherein said outlet walls of said first section seal against the outlet walls of the second section to define a sealed outlet chamber which is in communication with an outlet port of said pump; and wherein end edges of intake and outlet walls of said first and second sections are overmolded with an elastomeric sealing material.

* * * * *

UNITED STATES PATENT AND TRADEMARK OFFICE

CERTIFICATE OF CORRECTION

PATENT NO. : 6,916,157 B2
DATED : July 12, 2005
INVENTOR(S) : Leonhard

It is certified that error appears in the above-identified patent and that said Letters Patent is hereby corrected as shown below:

Column 4,
Line 21, change “Wherein” to -- wherein --.

Column 5,
Line 14, change “wail” to -- wall --.
Line 61, change “Intake” to -- intake --.

Signed and Sealed this

Sixth Day of December, 2005

JON W. DUDAS
*Director of the United States Patent and Trademark Office*